US010258151B2

(12) United States Patent
Nivens et al.

(10) Patent No.: US 10,258,151 B2
(45) Date of Patent: Apr. 16, 2019

(54) CHILDREN'S DRAWING TABLE

(71) Applicants: Ted Nivens, Winston-Salem, NC (US); Cindy Nivens, Winston-Salem, NC (US)

(72) Inventors: Ted Nivens, Winston-Salem, NC (US); Cindy Nivens, Winston-Salem, NC (US)

( * ) Notice: Subject to any disclaimer, the term of this patent is extended or adjusted under 35 U.S.C. 154(b) by 429 days.

(21) Appl. No.: 14/477,336

(22) Filed: Sep. 4, 2014

(65) Prior Publication Data

US 2015/0201748 A1 Jul. 23, 2015

Related U.S. Application Data

(60) Provisional application No. 61/880,339, filed on Sep. 20, 2013.

(51) Int. Cl.

| | |
|---|---|
| ***A47B 27/00*** | (2006.01) |
| ***A47D 3/00*** | (2006.01) |
| ***A47B 13/08*** | (2006.01) |
| ***B43L 1/04*** | (2006.01) |
| ***B43L 5/02*** | (2006.01) |

(52) U.S. Cl.

CPC ..... *A47B 27/00* (2013.01); *A47B 13/08* (2013.01); *A47D 3/00* (2013.01); *B43L 1/04* (2013.01); *B43L 5/025* (2013.01)

(58) Field of Classification Search

CPC ..... A47B 27/00; A47B 13/08; A47D 3/00; B43L 1/04; B43L 5/025

See application file for complete search history.

(56) References Cited

U.S. PATENT DOCUMENTS

| | | | | |
|---|---|---|---|---|
| 1,237,170 A | | 8/1917 | Cline | |
| 1,986,680 A | * | 1/1935 | Marcalus | B65H 19/2207 242/524.1 |
| 2,003,241 A | * | 5/1935 | Brown | A47B 23/001 108/131 |
| 2,507,931 A | | 5/1950 | Pizzonia | |
| 3,911,585 A | * | 10/1975 | McNeil | B43L 13/046 33/443 |
| 4,239,195 A | | 12/1980 | Oltman et al. | |
| 4,825,779 A | | 5/1989 | Simms | |

(Continued)

FOREIGN PATENT DOCUMENTS

WO WO 0105605 A1 * 1/2001 ..... B43L 5/02

*Primary Examiner* — James Hull

(74) *Attorney, Agent, or Firm* — Global Intellectual Property Agency, LLC; Daniel Boudwin

(57) ABSTRACT

Described is a drawing table having a flat, rectangular surface disposed horizontally and having a pair of parallel elongated support members attached on opposing sides of the surface. Spindles are provided on opposing ends of the rectangular surface, and the spindles connect the pair of parallel elongated support members. A roll of paper can be suspended on a spindle and the paper can be stretched across the surface. The free end of the paper can be secured on the opposing side of the table by threading the paper through a slot that extends through the opposing spindle. The surface may further include a chalkboard thereon and one or more paper holders that maintain the position of the paper on the surface. Further, the drawing table includes legs that can be folded for storage, or unfolded so as to support the drawing table surface in a horizontal, elevated position.

7 Claims, 2 Drawing Sheets

(56) References Cited

U.S. PATENT DOCUMENTS 4,908,742 A * 3/1990 Kersey ..... A45C 3/02
108/23
5,375,536 A * 12/1994 Peters ..... A47B 23/002
108/23
6,694,893 B2 2/2004 Alcala et al.

* cited by examiner

CHILDREN'S DRAWING TABLE

CROSS REFERENCE TO RELATED APPLICATION

This application claims the benefit of U.S. Provisional Application No. 61/880,339 filed on Sep. 20, 2013, entitled "Toddler Drawing Table." The above identified patent application is herein incorporated by reference in its entirety to provide continuity of disclosure.

BACKGROUND OF THE INVENTION

Field of the Invention

The present invention relates to drawing tables. More specifically, the present invention relates to a drawing table having a chalkboard surface and a pair of spindles on opposing sides of the table on which a roll of paper can be suspended. The paper can be drawn across the table surface and secured to the spindle on the opposing side. The drawing table includes a holder arranged on each end of the table through which the paper can be threaded in order to secure the paper to the surface of the table. The drawing table comprises folding legs for supporting the drawing table in an elevated position.

Toddlers and other young children enjoy participating in arts and crafts. Parents often encourage their children to draw, paint, or color in order to allow the child to express their creativity and to teach the child various other skills. By painting or drawing, children learn how to hold and use crayons, markers, and other writing utensils. Further, children learn to focus on a specific task and work through a project to its completion. Children may feel a sense of accomplishment for having completed a drawing, and a child's parents may reward and compliment the child on his or her drawing. Allowing a child to draw or paint may also serve to entertain and pacify the child.

While parents encourage children to draw, paint, and color, children may often attempt to draw on inappropriate surfaces such as walls and tables. Children may write or draw on such surfaces when appropriate art supplies are not available for the child to use. Paints and markers can create stains that are permanent or are difficult to remove. Thus, the parents may have to spend time cleaning and may have to pay to replace furniture or to have a wall repainted. Thus, a device that provides a child with a place to draw and that has surfaces on which the child can draw is desired.

The present invention provides a drawing table comprising a pair of parallel support members to which a flat, rectangular surface is secured. The parallel support members have apertures on each end that are adapted to receive an end of a spindle therethrough. Each spindle is adapted to have a roll of paper suspended thereon. In operation, a user can pull the paper disposed on a first spindle across the surface of the table so that the user can draw on the paper. The paper is secured at the opposite end of the table by threading the paper through the slot on the second spindle. The second spindle can then be wound so as to create a scroll of paper thereon. The surface of the table may comprise a chalkboard surface thereon, allowing a user to draw directly on the table surface. Further, the surface may have a holder arranged on each end that further helps to secure the paper onto the table. The drawing table also includes folding legs that can be folded for storage or extended to support the drawing table surface an elevated position.

DESCRIPTION OF THE PRIOR ART

Devices have been disclosed in the prior art that relate to drawing tables. These include devices that have been patented and published in patent application publications. These devices generally relate to tables adapted to hold a roll of paper wherein the paper can be extended onto the table surface. The following is a list of devices deemed most relevant to the present disclosure, which are herein described for the purposes of highlighting and differentiating the unique aspects of the present invention, and further highlighting the drawbacks existing in the prior art.

One such prior art device is U.S. Pat. No. 6,694,893 to Alcala et al., which discloses an art table having a top surface on which a user can draw. The surface has two ends with a pair of legs at each end. Each end has a brace thereon for supporting a plurality of drawing materials. A paper dispenser on which a roll of paper can be placed is positioned underneath the table and paper can be fed over the top surface of the table. Thus, Alcala fails to disclose a drawing table having holders thereon for securing the paper in place on the table surface, and further having a second spindle on the opposing side of the table that can be used to secure the paper extended across the table. Further, Alcala does not disclose a table having folding legs such that the table can be easily stored.

U.S. Pat. No. 1,237,170 to Cline discloses a table covering comprising chambers on each end of the table in which a reel of paper is enclosed. The paper passes underneath a roller on one end of the table and over a similar roller on the second end of the table. A paper tightening device is also provided. Thus, Cline fails to disclose a drawing table having folding legs and also having a chalkboard surface on which a user can draw.

U.S. Pat. No. 2,507,931 to Pizzonia discloses a combination drawing table and desk having a concealed roll of paper that can be fed over the top of the table and clamped in position. An upper frame is arranged above the table frame and opens a limited extent so that paper can be secured, and so that a child's finger cannot become stuck therein. Thus, Pizzonia does not disclose a drawing table having a first and second spindle wherein a roll of paper is disposed on a first spindle, fed across the table, and is secured within the second spindle. Further, Pizzonia does not disclose a drawing table with folding legs.

U.S. Pat. No. 4,239,195 to Oltman et al. discloses a workbench having a pair of collapsible legs. Tool holders can be attached to the legs to provide a user with convenient storage. The workbench has a planar benchtop with a section for storing power tools therein. The workbench comprises a pair of vices that cooperate with the planar benchtop. Thus, Oltman fails to disclose a drawing table having a chalkboard surface and that is adapted to hold a roll of paper that can be extended across the table surface.

Finally, U.S. Pat. No. 4,825,779 to Simms discloses a table for use while the user is sitting on a toilet. The table has a spindle that can support a roll of toilet paper thereon. The tabletop has a slanted surface for the user's convenience, and the tabletop is supported by legs. The table is adapted to hold books or other objects thereon. Thus, Simms fails to disclose a drawing table having folding legs and having a chalkboard surface on which a user can draw or write.

These prior art devices have several known drawbacks. Some devices in the prior art disclose a table having a means for holding a roll of paper thereon. However, these devices do not include a spindle on the opposing side of the table through which the paper can be threaded and wound. Without a means for securing the paper, the paper can shift and move on the table surface, which may disrupt the user of the table. Further, the tables in the prior art do not disclose a children's drawing table having folding legs such that the table can be easily stored. A conventional table consumes a substantial amount of space and is difficult to transport. The folding legs reduce the overall size of the device and allow the device to be easily stored in a closet or other area.

In light of the devices disclosed in the prior art, it is submitted that the present invention substantially diverges in design elements from the prior art and consequently it is clear that there is a need in the art for an improvement to existing children's drawing table devices. In this regard the instant invention substantially fulfills these needs.

SUMMARY OF THE INVENTION

In view of the foregoing disadvantages inherent in the known types of drawing tables now present in the prior art, the present invention provides a new drawing table wherein the same can be utilized for providing convenience for the user when drawing on a surface.

It is therefore an object of the present invention to provide a new and improved children's drawing table device that has all of the advantages of the prior art and none of the disadvantages.

It is another object of the present invention to provide a children's drawing table having a chalkboard surface on which a user can directly draw or write.

Another object of the present invention is to provide a children's drawing table having a means for holding a roll of paper and a means for extending the paper across the drawing table.

Yet another object of the present invention is to provide a children's drawing table adapted to secure paper on the table surface to facilitate drawing on the paper.

A further object of the present invention is to provide a children's drawing table having folding legs such that the drawing table can be folded into a compact configuration that is convenient for storage.

Another object of the present invention is to provide a children's drawing table that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
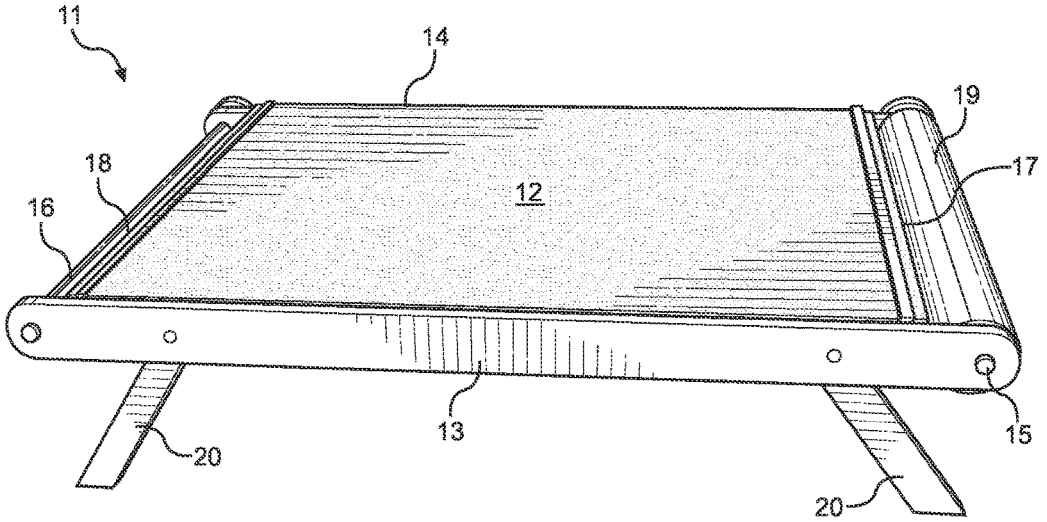
FIG. 1 shows a perspective view of the children's drawing table of the present invention.

Reference is made herein to the attached drawings. Like reference numerals are used throughout the drawings to depict like or similar elements of the drawing table. For the purposes of presenting a brief and clear description of the present invention, the preferred embodiment will be discussed as used for providing a surface on which a child can draw. The figures are intended for representative purposes only and should not be considered to be limiting in any respect.

Referring now to FIG. 1, there is shown a perspective view of the children's drawing table of the present invention. The present invention comprises a flat, rectangular surface 12 on which a user can draw or write. The surface 12 may be composed of plastic, metal, wood or any other rigid, durable material. In some embodiments of the present invention, the surface 12 comprises a chalkboard surface such that a user can draw directly on the surface 12 using chalk. In this way, the user can use the table surface 12 as a drawing surface when the user does not have paper or other art supplies available.

The surface 12 comprises a first end 17, a second end 18, a first side, and a second side that define the perimeter of the surface 12. The first and second ends 17,18 of the surface 12 are substantially parallel to one another, and the first and second sides are substantially parallel to one another. The surface 12 is attached on a first side to a first elongated support member 13 and attached on an opposing, second side to a second elongated support member 14. The first and second support members 13,14 are parallel to one another and extend along the length of the surface 12 and extend past the first and second ends 17,18 of the surface 12. In a preferred embodiment of the present invention, the ends of the support members 13,14, which extend beyond the length of the surface 12 edges, are rounded ends so as to eliminate any sharp corners on the drawing table 11. Each end of each support 13,14 further comprises an aperture that is adapted to receive a portion of a spindle therethrough.

A first spindle 15 is disposed adjacent to the first end 17 of the surface 12 and is substantially parallel thereto. Further, a second spindle 16 is disposed adjacent to the second end 18 of the surface 12 and is substantially parallel thereto. Each spindle 15,16 comprises an elongated pin with a flat disk disposed on one end thereof. In a preferred embodiment of the present invention, the elongated pin of the spindle 15,16 is substantially cylindrical. The elongated pin is inserted through an aperture on the first support 13 and is rotatably secured within an aperture on the second support 14, such that the spindles are adapted to rotate therein. The flat disk is sized so that it is unable to pass through said apertures, and the flat disk allows a user to rotate the elongated pin and thus the roll of paper thereon. The user can simply turn the flat disk in a clockwise or counterclockwise direction to extend paper from the roll of paper. The flat disk may comprise a circular shape, or may have any of a variety of other shapes such as a square shape. A conventional roll of paper 19 comprising a central, cylindrical tube can be positioned on a spindle such that it is bounded on each end by the support members 13,14. In this way, the roll of paper 19 is secured on the spindle 15 and between the support members 13,14 such that the paper cannot fall off of the spindle 15. The roll of paper 19 is able to rotate thereon such that paper can easily be unrolled from the roll of paper 19.

The present invention also comprises a plurality of legs 20 pivotally secured to the support members 13,14. In an unfolded configuration, the legs 20 support the surface 12 in an elevated, horizontal position so that a user can conveniently use the table surface 12 for drawing and other activities. In a folded configuration, the legs 20 are parallel to the support members 13,14 and are concealed thereby, allowing for easy storage of the drawing table 11. In a preferred embodiment of the present invention a pair of legs 20 are pivotally secured to the first support member 13, and a second pair of legs 20 is pivotally secured to the second support member 14. In order to position the legs in the folded configuration, the legs 20 fold inward, towards a central portion of the drawing table 11. Further, in some embodiments of the present invention, the legs 20 are sized such that the drawing table surface 12 can be used while a user seated on a floor. However, alternate embodiments of the drawing table are sized so that a child can use the table while seated in a chair.

Figure 2:
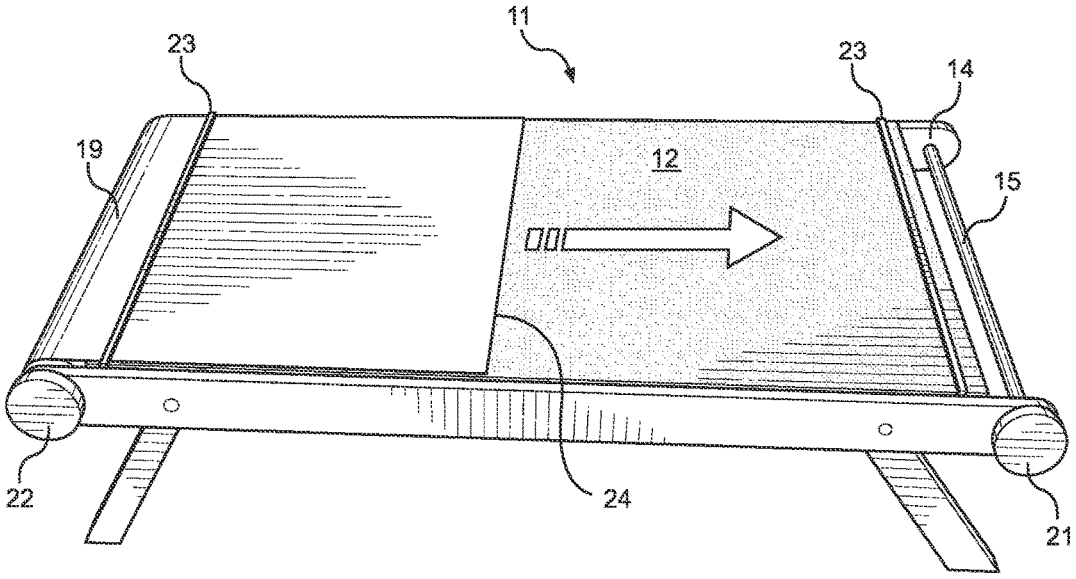
FIG. 2 shows a perspective view of the children's drawing table of the present invention with paper extended across the surface thereof.

Referring now to FIG. 2, there is shown a perspective view of an embodiment of the drawing table of the present invention with paper extended across the surface thereof. With a roll of paper 19 positioned on a spindle, the paper 19 can be drawn across the surface 12 of the drawing table 11. The drawing table 11 comprises a first holder 23 comprising an elongated bar that is parallel to the table and is spaced therefrom. The first holder 23 is secured to the edges of the surface 12 or to the support members 13,14, such that a piece of paper 19 can be threaded between the first holder 23 and the table surface 12. The first holder 23 helps to position the paper 19 against the table surface 12 so as to maintain the paper 19 close to the table surface 12 and to prevent the paper 19 from moving thereon. The user can pull the leading edge 24 of the paper across the surface 12 and underneath a second holder 23 positioned on the opposing end of the surface 12. One or more holders 23 may be positioned on the surface 12 of the drawing table 11. Preferably, the holders 23 are positioned on opposing ends of the drawing table 11 so that the holders 23 do not interfere with the central area of the drawing table 11 where a user is likely to draw.

Figure 3:
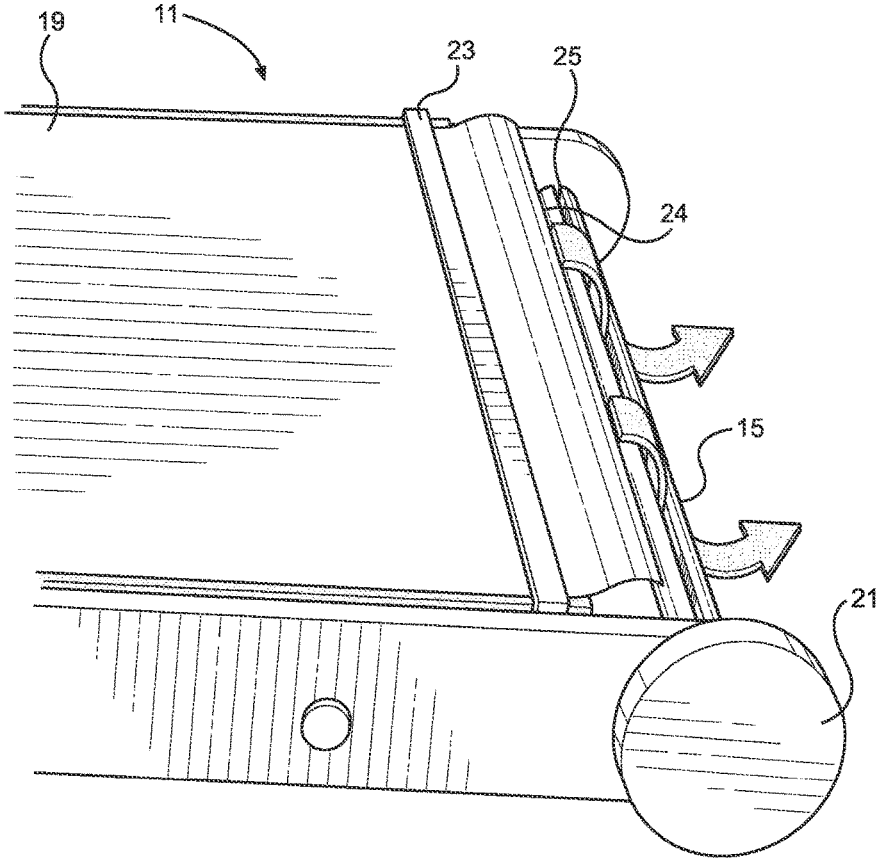
FIG. 3 shows a close-up view of paper being fed through a spindle of the present invention.

Referring now to FIG. 3, there is shown a close-up view of paper being fed through a spindle of the present invention. Once the paper 19 has been drawn across the surface of the drawing table 11, the user can secure the paper 19 at the opposing end of the drawing table 11 by threading the leading edge 24 of the paper 19 through a slot 25 on the second spindle 15. In a preferred embodiment, the slot 25 extends along the length of the spindle 15, and extends through the diameter of the cylindrical pin of the spindle. Once the paper is threaded through the slot 25 on the spindle 15, the user can then wind the second spindle 15 by rotating the flat disk 21 thereon, so as to create a scroll of paper on the second spindle 15. In this way, the paper 19 is securely held on the table surface between the spindles, and the user can extend a clean sheet of paper onto the table from the roll of paper by turning the flat disk portion of either spindle.

Figure 4:
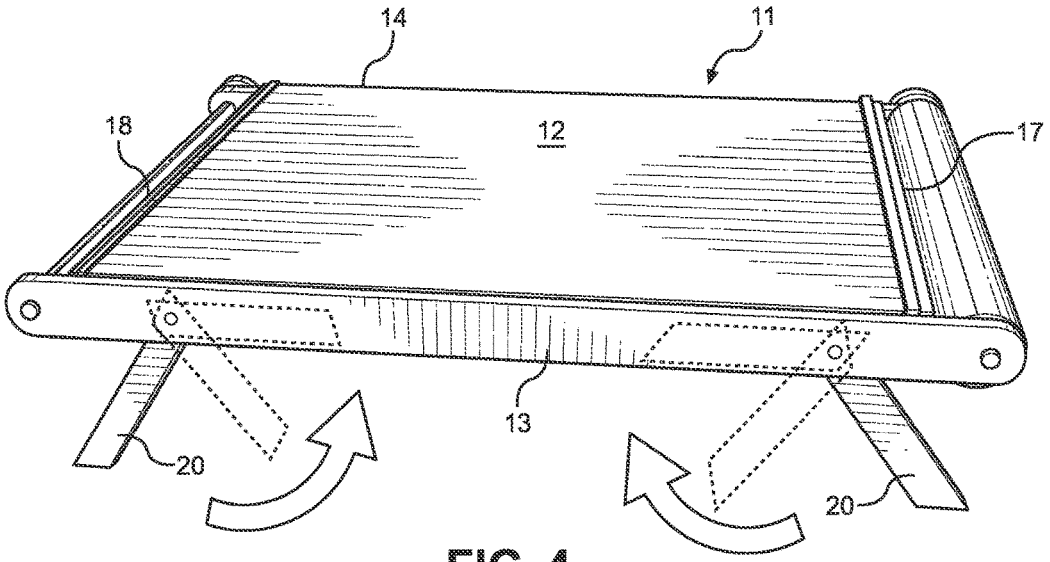
FIG. 4 shows a perspective view of the children's drawing table of the present invention showing the manner in which the legs may be folded for storage.

Referring now to FIG. 4, there is shown a perspective view of the drawing table of the present invention showing the manner in which the legs may be folded for storage. A pair of legs 20 is pivotally secured to a first support member 13 and a second pair of legs 20 is pivotally secured to a second support member 14. The first and second pair of legs 20 are pivotally connected to the first and second support member 13,14 such that the legs 20 can rotate between a folded and an unfolded configuration. In the folded configuration, the legs are substantially parallel to the first and second support members 13,14, and the legs 20 are flush with the first and second support members 13,14. In this way, the folded configuration is compact and convenient for storage in a closet or underneath a bed.

In the unfolded configuration, the legs 20 support the table surface 12 in an horizontal, elevated position above the ground. In some embodiments of the present invention, the legs 20 are substantially perpendicular to the surface 12 when in the unfolded configuration. In other embodiments of the present invention, the legs 20 are disposed at an angle relative to one another as shown in FIG. 4. In this way, the legs provide a wide base to stabilize and support the drawing table. Where, the legs 20 are disposed at an angle relative to one another, each leg 20 is shaped as a parallelogram such that the bottom of the legs 20 can be positioned flush against the floor or other surface. From the unfolded configuration, the legs 20 can be folded inward and towards a central portion of the drawing table 11 in order to stow the legs 20 in the folded configuration.

Children enjoy drawing and other such arts and crafts, but often lack sufficient space to perform these activities. Parents often encourage children to draw and color, and allow a child to use a coffee table or dining room table as a drawing surface, but children may accidentally or intentionally draw on these surfaces. Thus, parents must clean stray markings on furniture and walls which may be time consuming and expensive for the parents. The present invention provides a children's drawing table comprising a surface on which a child can draw. The drawing table also includes spindles for holding a roll of paper thereon, wherein the paper can be drawn across the table surface and secured on the opposing side of the table. The drawing table includes folding legs such that the drawing table can be easily stowed when not in use.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A children's drawing table, comprising:

a rectangular surface including a first end opposing a second end, the rectangular surface attached to a first elongated support member and a second elongated support member, the rectangular surface positioned evenly between the first and the second elongated members along a common plane;

wherein the first and the second elongated support members extend horizontally along a longitudinal length of the rectangular surface;

wherein the first and the second elongated support members are positioned parallel relative to one another and perpendicularly relative to the first end and the second end;

wherein the first and the second elongated members extend beyond the first end and the second end;

a first spindle rotatably coupled to the first and the second elongated members, the first spindle including an elongated pin having a flat disk with a diameter greater than a width of the first elongated member disposed at an end thereof, wherein the width is between an upper side and a lower side of the first elongated member, the flat disk of the first spindle configured to rotate the first spindle;

wherein the first spindle is disposed adjacent to the first end and positioned parallel to the first end;

a second spindle rotatably coupled to the first and the second elongated members, the second spindle including an elongated pin having a flat disk with a diameter greater than a width of the first elongated member disposed at an end thereof, wherein the width is between an upper side and a lower side of the first elongated member, the flat disk of the second spindle configured to rotate the second spindle;

wherein the second spindle is disposed adjacent to the second end and positioned parallel to the second end;

wherein the first spindle and the second spindle are disposed such that the flat disk on each spindle is proximal to the same elongated member;

a first enclosed aperture inset from an edge of the first elongated member and a second enclosed aperture inset from an edge of the second elongated member, wherein each aperture is configured to receive a spindle therethrough; and a plurality of legs pivotally attached to the first and the second elongated members, wherein each leg has a width less than the width of the first elongated member, the plurality of legs configured to rotate inwardly along a longitudinal length of the first and the second elongated members.

2. The drawing table of claim 1, further comprising:

a first slot extending along a length of the first spindle, the first slot extending radially inwardly through a diameter of the first spindle; and a second slot extending along a length of the second spindle, the second spindle extending radially inwardly through a diameter of the second spindle.

3. The drawing table of claim 1, further comprising:

a first holder inset from an edge of the first end, the first holder extending linearly along a width of the rectangular surface between the first and the second elongated members and positioned parallel relative to the first spindle; and a second holder inset from an edge of the second end, the second holder extending vertically linearly along a width of the rectangular surface between the first and the second elongated members and positioned parallel relative to the second spindle.

4. The drawing table of claim 1, wherein the rectangular surface is composed of a chalkboard.

5. The drawing table of claim 1, wherein the first elongated support member and the second elongated support member each include a first end and a second end, each of the first and second ends of the elongated support members having an aperture disposed thereon, the apertures configured to receive a spindle therethrough, the apertures of the first ends of the elongated support members being aligned and the apertures of the second ends of the elongated support members being aligned, such that the first spindle can be inserted through the apertures of the first ends of the first and second elongated support members and the second spindle can be inserted through the apertures of the second ends of the first and second elongated support members.

6. The drawing table of claim 1, wherein the first elongated support member and the second elongated support member each include rounded ends.

7. The drawing table of claim 1, wherein the plurality of legs comprise a first pair of legs and a second pair of legs, the first pair of legs pivotally attached to the first elongated support member, the second pair of legs pivotally attached to the second elongated support member.

* * * * *